United States Patent [19]

Hawkins

[11] 4,199,208

[45] Apr. 22, 1980

[54] HERMAPHRODITIC SPLICE TERMINAL

[75] Inventor: Harold G. Hawkins, Bristolville, Ohio

[73] Assignee: General Motors Corporation, Detroit, Mich.

[21] Appl. No.: 971,899

[22] Filed: Dec. 21, 1978

[51] Int. Cl.[2] ..... H01R 13/28

[52] U.S. Cl. ..... 339/47 R

[58] Field of Search ..... 339/47 R, 47 C; 24/201 R

[56] References Cited

U.S. PATENT DOCUMENTS

| | | | |
|---|---|---|---|
| 2,523,465 | 9/1950 | Graham | 339/47 R |
| 2,615,736 | 10/1952 | Bergan et al. | 339/47 R |
| 3,146,051 | 8/1964 | Woofter et al. | 339/47 R |
| 3,419,843 | 12/1968 | Hays | 339/47 R |
| 3,471,823 | 10/1969 | Renshaw, Jr. | 339/47 R |
| 3,516,043 | 6/1970 | Spofford | 339/47 R |

*Primary Examiner*—Neil Abrams

*Attorney, Agent, or Firm*—F. J. Fodale

[57] ABSTRACT

A hermaphroditic splice terminal comprises a forward resilient contact portion having a pair of laterally squeezable tines projecting from a base which is connected to a narrow assembly neck. The rearward portion of the terminal has a pair of flanged clasping ears located between core and insulation crimp wings securing the terminal to a lead wire. The terminal is substantially flat with the clasping ears and crimp wings projecting laterally in opposite directions to avoid interference when the terminal is coupled to an identical terminal. The tines of each terminal incorporate latch and stop shoulders which cooperate with the flanged clasping ears of the other terminal to lock the terminals in the coupled position.

3 Claims, 9 Drawing Figures

HERMAPHRODITIC SPLICE TERMINAL

This invention relates generally to hermaphroditic splice terminals and more particularly to hermaphroditic splice terminals which are permanently attached to lead wire ends and coupled to splice the lead wires together.

U.S. Pat. No. 2,523,465 issued Sept. 26, 1950 to Maxwell A. Graham for an "Electrical Terminal Clasp Connector"; U.S. Pat. No. 2,615,736 issued Oct. 28, 1952 to Martin D. Bergan and Maxwell A. Graham for an "Electrical Clasp Connector" and U.S. Pat. No. 3,516,043 issued June 2, 1970 to Thomas G. Spofford for a "Hermaphroditic Disconnect Terminal" all disclose hermaphroditic splice terminals characterized by a resilient contact, flanged clasp ears which effect a bias of the resilient contact when two identical terminals are coupled together, and an assembly neck used in coupling the two terminals together. In each design, the width of the assembly neck matches the spacing between the flanged clasping ears. Terminal coupling is initiated by setting the assembly neck of each terminal between the clasping ears of the other terminal via the flange spacing. The lead wires to which the two terminals are attached are then pulled apart sliding the terminals longitudinally on each other to a coupled position.

The object of this invention is to provide a hermaphroditic splice terminal of this general type which is narrow in width and short in height for use in applications, such as automotive wiring harnesses, where several pairs of lead wires are spliced together.

Another object of this invention is to provide a hermaphroditic splice terminal which, while narrow in width, still retains a substantial current carrying capacity.

Another object of this invention is to provide a hermaphroditic splice terminal in which the resilient contact comprises a pair of tines which are squeezed together when coupled to an identical terminal to provide high contact forces for a good electrical connection.

Another object of the invention is to provide a hermaphroditic splice terminal having its leading wire attaching means disposed to reduce the length of the terminal and the overall length of two such terminals when coupled.

A feature of the invention is that the hermaphroditic splice terminal is substantially flat utilizing a flat resilient laterally squeezable contact portion and clasping ears of minimum height.

Another feature of the hermaphroditic splice terminal is that the clasping ears are placed rearwardly of the assembly neck to increase the current carrying capacity of coupled terminals.

Another feature of the invention is that the clasping ears and lead wire attaching portions project in opposite lateral directions from the substantially flat terminal to reduce the length of each terminal as well as the overall length of two such terminals when coupled together.

Another feature of the invention is the incorporation of detent means in a manner which does not affect the reduced height of the terminal.

Other objects and features of the invention will become apparent to those skilled in the art as the disclosure is made in the following detailed description of a preferred embodiment of the invention as illustrated in the accompanying sheets of drawing in which.

Figure 1:
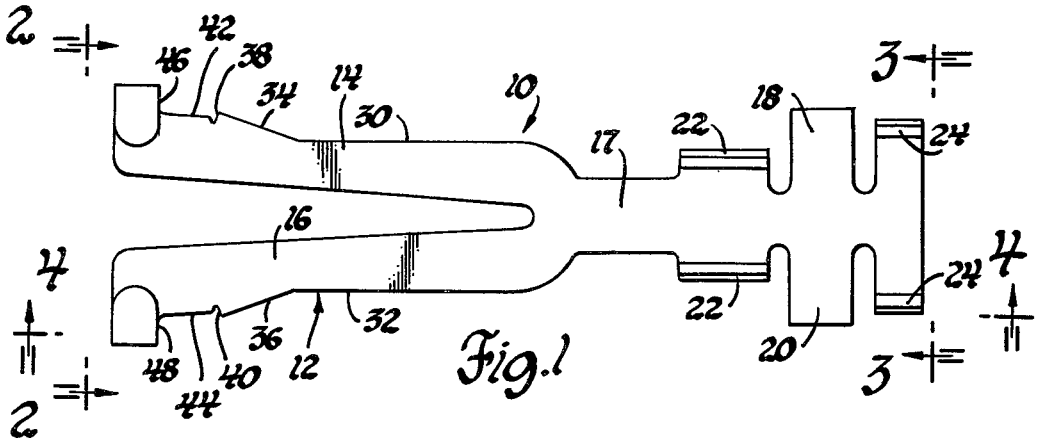
FIG. 1 is a top view of a hermaphroditic splice terminal in accordance with this invention.
Figure 2:
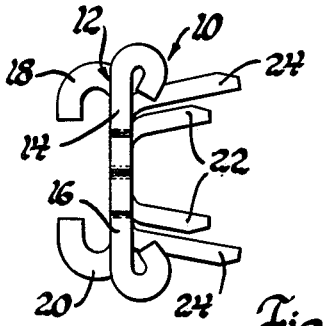
FIG. 2 is a front view of the terminal shown in FIG. 1 taken substantially along the line 2—2 of FIG. 1 looking in the direction of the arrows.
Figure 3:
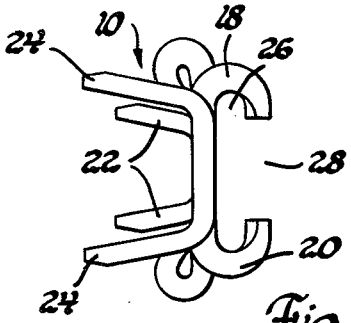
FIG. 3 is a rear view of the terminal shown in FIG. 1 taken substantially along the line 3—3 of FIG. 1 looking in the direction of the arrows.
Figure 4:
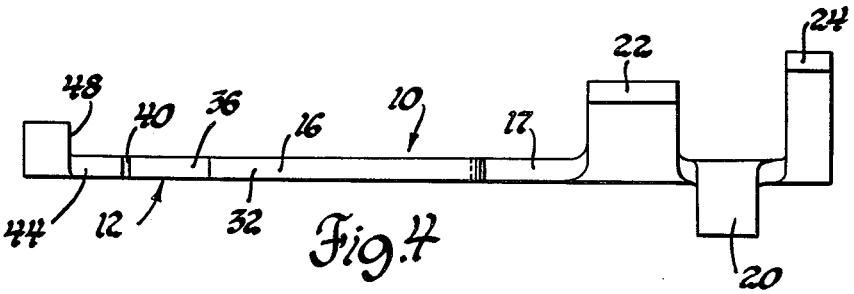
FIG. 4 is a side view of the terminal shown in FIG. 1 taken substantially along the line 4—4 of FIG. 1 looking in the direction of the arrows.

Referring now to the drawing and more particularly to FIGS. 1-4 and 9, the hermaphroditic splice terminal 10 is substantially flat and has a forward resilient contact portion 12 comprising a pair of flat tines 14 and 16 projecting from a base which is connected to an intermediate assembly neck portion 17 of reduced width. The rearward portion of the terminal 10 is partially flat and coplanar with the contact portion 12 and assembly neck portion 17 and partially projects laterally to provide a pair of flanged clasping ears 18 and 20 and core and insulation crimp wings 22 and 24 which permanently attach the terminal 10 to a lead wire. The clasping ears 18 and 20 are located between the core crimp wings 22 and the insulation crimp wings 24 and project laterally from the substantially flat terminal 10 in one direction while the crimp wings 22 and 24 project in the opposite lateral direction as best seen in FIGS. 2, 3 and 4.

The flanged clasping ears 18 and 20 are C-shaped in section (See FIGS. 2, 3 and 9) defining a slot 26 and a flange spacing 28 of reduced width which opens into the slot 26. The width of the flange spacing 28 matches the width of the assembly neck 17 for initially coupling the terminal 10 to an identical terminal while the width of the slot 26 is specifically related to the forward resilient contact portion 12 to effect a biased engagement upon complete coupling.

The forward resilient contact portion 12, as previously noted, comprises two flat tines 14 and 16 having a base connected to the assembly neck portion 17.

The resilient contact portion 12 near the assembly neck 17 has parallel outer edges 30 and 32 defined by the tines 14 and 16 which are spaced so that these tine portions are slidable in the slot 26 formed by the clasping ears 18 and 20. The outer edges of the tines 14 and 16 then diverge away from each other providing diverging cam surfaces 34 and 36 which increase the width of the contact portion 12 to a width greater than that of the slot 26. The outer edges of the tines 14 and 16 then step in forming latch shoulders 38 and 40 and substantially parallel contact surfaces 42 and 44 which define a width which is significantly greater than the width of the slot 26. The tines 14 and 16 have laterally extending tabs at their tips which provide stop shoulders 46 and 48. The tabs are reversely folded in the direction of the crimp wings 22 and 24 to avoid interference during coupling.

Figure 5:
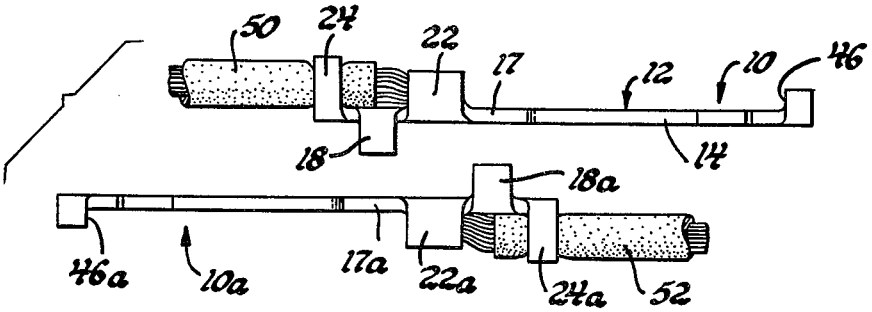
FIG. 5 is a side view showing two lead wires each having a hermaphroditic splice terminal of FIGS. 1-4 attached to its end. The two terminals are shown positioned for initiating coupling to each other.
Figure 6:
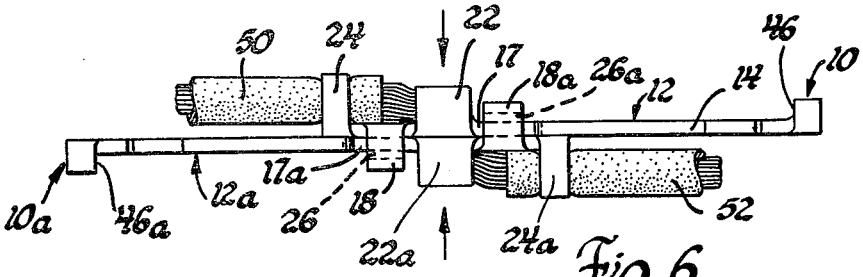
FIG. 6 is a side view similar to FIG. 5 showing the two terminals initially coupled to each other.
Figure 7:
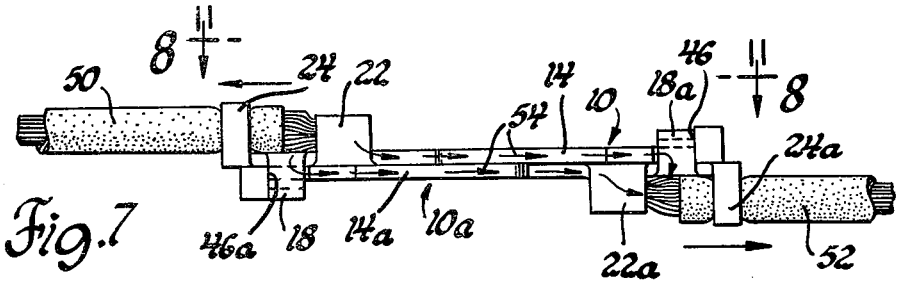
FIG. 7 is a side view similar to FIG. 6 showing the two splice terminals completely coupled to each other.
Figure 8:
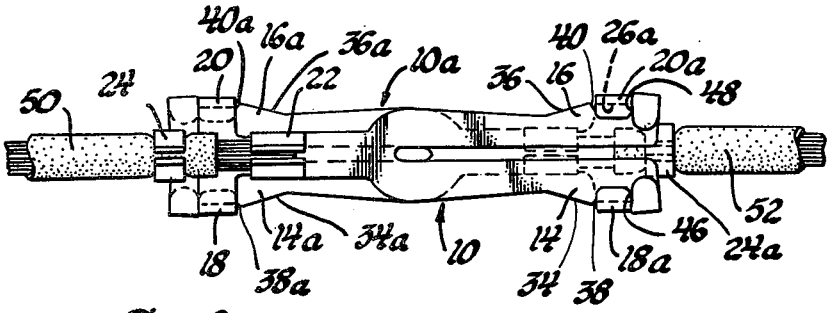
FIG. 8 is a top view of the coupled terminals shown in FIG. 7 taken substantially along the line 8—8 of FIG. 7 looking in the direction of the arrows.
Figure 9:
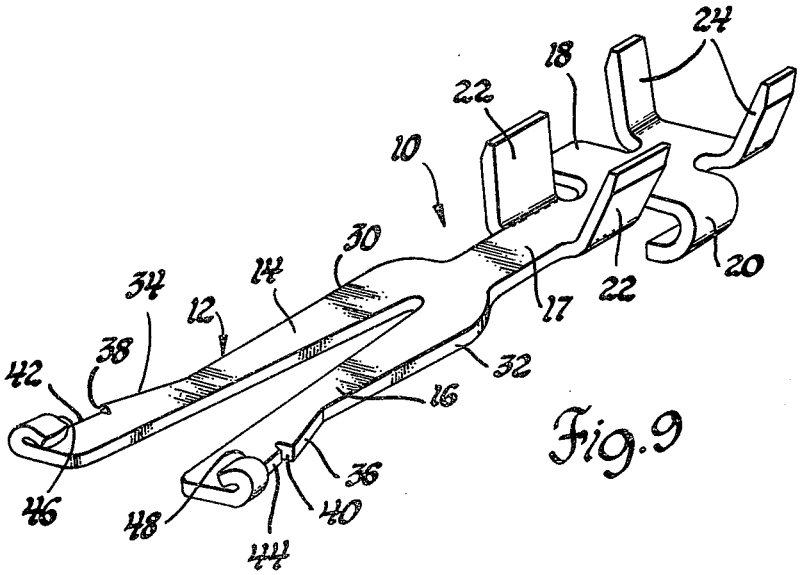
FIG. 9 is a perspective view of the hermaphroditic splice terminal shown in FIGS. 1, 2, 3 and 4.

The hermaphroditic splice terminal 10 is coupled to an identical terminal as shown in FIGS. 5, 6, 7 and 8. (For convenience the second terminal is identified as 10*a* and its corresponding parts likewise are identified with the letter designation a.) Identical terminals 10 and 10*a*, permanently attached to respective lead wires 50 and 52 in a more or less conventional manner by the crimp wings 22, 22*a*, 24 and 24*a*, are positioned as shown in FIG. 5 for initiating coupling. In this position, the clasping ears 18 and 20 of terminal 10 are aligned with the assembly neck 17*a* of terminal 10*a* and vice versa. The terminals 10 and 10*a* are then initially coupled in the lateral direction so that the assembly neck 17*a* of terminal 10*a* is disposed in the slot 26 formed by the clasping ears 18 and 20 of the terminal 10 and the assembly neck 17 of terminal 10 is disposed in the slot 26*a* of terminal 10*a* as shown in FIG. 6. The lead wires 50 and 52 are then pulled away from each other in the longitudinal direction causing the terminals 10 and 10*a* to slide on each other to the coupled position shown in FIGS. 7 and 8. As the terminals 10 and 10*a* slide to the coupled position, the clasping ears 18, 20, and 18*a*, 20*a* of the respective terminals engage the cam surfaces 34, 36, and 34*a*, 36*a* of the other terminal respectively squeezing the pairs of tines 14, 16 and 14*a*, 16*a* laterally inwardly. The clasping ears 18 and 20 snap past the latch shoulders 38*a* and 40*a* and engage the contact surfaces 42*a* and 44*a* under bias of the laterally squeezed tines 14*a* and 16*a* while the clasping ears 18*a* and 20*a* are biasingly engaged by the tines 14 and 16 in the same manner. The stop shoulders 46, 48 and 46*a*, 48*a* prevent the terminals 10 and 10*a* from being pulled apart and the latch shoulders 38, 40 and 38*a*, 40*a* prevent uncoupling in the opposite direction.

Since the crimp wings and the clasping ears of each terminal project in opposite lateral directions the crimp wings 22, 24 and 22*a*, 24*a* cannot interfere during terminal coupling. Consequently each terminal and the overall length of the coupled terminals 10 and 10*a* is considerably shorter than if the lead wire attachment and clasping ear arrangements shown in the prior art patents mentioned heretofore were used. The coupled terminals 10 and 10*a* also provide parallel flow paths from the clasping ears of each terminal to the core crimp wings of the other terminal as shown by the arrows 54 in FIG. 7. Thus the narrow assembly necks 17, 17*a* each carry only half the current and consequently the current capacity of the terminals 10 and 10*a* is not limited by the narrow width of a single assembly neck as in some prior art arrangements. Since the terminal tines are flat, the clasping ears are of a minimum height thereby further enhancing the compactness of the terminals. Further the terminals incorporate a detent arrangement comprising the clasping ears themselves and latch shoulders and stop shoulders which do not increase height requirements.

I wish it to be understood that I do not desire to be limited to the exact details of construction shown and described, for obvious modifications will occur to a person skilled in the art.

The embodiments of the invention in which an exclusive property or privilege is claimed are defined as follows:

1. A hermaphroditic splice terminal adapted for coupling to a terminal of identical construction, comprising:

a forward resilient contact portion having a pair of laterally squeezable tines projecting from a base, an intermediate assembly neck of reduced width connected to the base, a pair of flanged clasping ears which are located rearwardly of the assembly neck and which project laterally of the forward contact portion and the assembly neck, said flanged clasping ears defining a flange spacing for receiving the assembly neck of an identical terminal to initiate coupling thereto and a slot dimensioned to squeeze the tines of the identical terminal toward each other when coupled thereto, and a pair of crimp wings which are located between the assembly neck and the pair of flanged clasping ears and which project in a lateral direction opposite that of the flanged clasping ears to avoid interference when the terminal is coupled to the identical terminal.

2. A hermaphroditic splice terminal adapted for coupling to a terminal of identical construction, comprising:

a substantially flat body having a forward portion, an intermediate portion and a rearward portion, said forward portion having a pair of laterally squeezable tines projecting from a base to provide a foward resilient contact portion, said intermediate portion including an assembly neck of reduced width, and said rearward portion further comprising a pair of flanged clasping ears and longitudinally spaced pairs of crimp wings which project laterally of the flat body in opposite directions, said pair of flanged clasping ears being located between the pairs of crimp wings and defining a flange spacing for receiving the assembly neck of an identical terminal to initiate coupling thereto and a slot dimensioned to squeeze the tines of the identical terminal toward each other when coupled thereto.

3. A hermaphroditic splice terminal adapted for coupling to a terminal of identical construction, comprising:

a forward resilient contact portion having a pair of flat laterally squeezable tines projecting from a flat coplanar base, said tines having outer edges configured to provide diverging cam surfaces, latch shoulders, contact surfaces and stop shoulders serially arranged in a forward direction, an intermediate assembly neck of reduced width connected to the base which is flat and coplanar with the tines and base, a pair of flanged clasping ears which are located rearwardly of the assembly neck and which project laterally of the flat, coplanar tines, base and assembly neck, said flanged clasping ears defining a flange spacing for receiving the assembly neck of an identical terminal to initiate coupling and a slot dimensioned to squeeze the tines of the identical terminal toward each other and engage the contact surfaces of the identical terminal when coupled thereto, a rearward lead wire attachment portion which projects in a lateral direction opposite that of the flanged clasping ears to avoid interference when the terminal is coupled to the identical terminal, and said flanged clasping ears being cooperable with the latch and stop shoulders of the identical terminal to lock the terminals in the coupled position.

* * * * *